US006039547A

United States Patent [19]

Hendrix et al.

[11] Patent Number: 6,039,547

[45] Date of Patent: Mar. 21, 2000

[54] COMPRESSOR WITH COMPRESSOR BASE THAT INCLUDES FLUID SUPPLY OPENINGS

[75] Inventors: Dean P. Hendrix, Mocksville; David F. Rowe, Jr., Advance, both of N.C.

[73] Assignee: Ingersoll-Rand Company, Woodcliff Lake, N.J.

[21] Appl. No.: 09/149,157

[22] Filed: Sep. 4, 1998

Related U.S. Application Data

[60] Provisional application No. 60/057,488, Sep. 4, 1997.

[51] Int. Cl.[7] ..... F04B 53/00

[52] U.S. Cl. ..... 417/234; 417/313; 417/364; 123/2

[58] Field of Search ..... 417/313, 234, 417/364; 290/1 R, 1 A; 123/2

[56] References Cited

U.S. PATENT DOCUMENTS

| | | | |
|---|---|---|---|
| 3,478,958 | 11/1969 | Hinck, III . | |
| 3,612,213 | 10/1971 | Piko . | |
| 3,989,415 | 11/1976 | Van-Hee . | |
| 4,057,368 | 11/1977 | Balling . | |
| 4,359,085 | 11/1982 | Mueller . | |
| 4,702,201 | 10/1987 | Odo et al. | 123/2 |
| 5,407,330 | 4/1995 | Rimington . | |
| 5,433,175 | 7/1995 | Hughes et al. | 123/2 |
| 5,575,349 | 11/1996 | Ikeda et al. . | |
| 5,626,468 | 5/1997 | Muir et al. . | |
| 5,795,136 | 8/1998 | Olsaker et al. | 417/295 |
| 5,908,011 | 6/1999 | Stauffer et al. | 123/2 |

*Primary Examiner*—Erick R. Solis
*Assistant Examiner*—Arnold Castro
*Attorney, Agent, or Firm*—Michael M. Gnibus

[57] ABSTRACT

A compressor that includes a base; a housing supported on said base, said housing and base defining a compression chamber; and a compression module supported on said base within said compression chamber, said base including at least two support channels, each of the at least two support channels including a first group of flow openings for supplying a volume of uncompressed fluid to the compression module.

8 Claims, 3 Drawing Sheets

COMPRESSOR WITH COMPRESSOR BASE THAT INCLUDES FLUID SUPPLY OPENINGS

This appln claims the benefit of U.S. Provisional No. 60/057,488 filed Sep. 4, 1997.

BACKGROUND OF THE INVENTION

The invention relates to a fluid compressor. More particularly, the invention relates to a fluid compressor having a compression module enclosed by a compressor housing and supported by a compressor base that includes fluid supply openings through which a portion of the total volume of uncompressed fluid is flowed to the compression module.

Fluid compressors by their design draw ambient fluid, such as air, through openings provided in the fluid compressor housing into the compressor package, and the volume of drawn ambient fluid is utilized by the compressor in several ways. A portion of the volume of air drawn into the compressor package is flowed through the compressor inlet valve into the compressor compression module, is compressed to a high pressure, and is discharged under pressure through the compressor discharge port to an object of interest such as a pneumatic tool for example. Of the volume of drawn air that is not compressed by the fluid compressor, a portion of the drawn volume is flowed past the compression module and other compressor components to cool the module and components, and if the compressor is an engine driven compressor, a portion of the drawn volume is also supplied to the engine to serve as combustion air for the engine.

The total area of the housing openings necessary to draw the required volume of ambient fluid into the package during compressor operation is dependent upon the cubic feet per minute (CFM) flow requirements of the engine, the compression module, and the cooling system. Additional housing openings must be provided in order to effectively exhaust the cooling air out of the compressor package. The total area for drawing inlet fluid into the package and exhausting cooling fluid out of the package is achieved by incorporating holes, grilles, grates, louvers and other openings in the compressor housing that are located on the housing, and designed and sized to provide the necessary inlet and exhaust fluid flow without an increase in the noise emitted by the compressor.

With the focus today on creating smaller and quieter compressors, the problems associated with providing openings of sufficient area in the enclosure of an air compressor are many. In order to provide an adequate flow of ambient air into the package without permitting an excessive amount of noise to be emitted by the package, interior baffles are often used at or near ambient air intake openings. These baffles increase the cost, weight, and complexity of the compressor. If the baffles were not required to reduce compressor sound emission, the size of the package could be reduced, or the space required to house the baffles could be used to house additional compressor components that could be used to increase the efficiency of the compressor.

Acoustical foam or other sound deadening material is often utilized for the purposes of reducing the compressor operating noise level. Any sound deadening material also contributes to the cost and complexity of the compressor package.

The foregoing illustrates limitations known to exist in present devices and methods. Thus, it is apparent that it would be advantageous to provide an alternative compressor that includes flow openings that are large enough to provide the requisite inlet and exhaust flowrates without creating high compressor noise emission levels. Accordingly, a suitable alternative is provided including features more fully disclosed hereinafter.

SUMMARY OF THE INVENTION

In one aspect of the present invention, this is accomplished by providing a compressor that includes a base, a housing supported on said base, said housing and base defining a compression chamber; and a compression module supported on said base within said compression chamber, said base including at least two support channels, each of the at least two support channels including a first group of flow openings for supplying a volume of uncompressed fluid to the compression module. The first group of flow openings have a substantially oval shape, and the first group of openings is located along a top side of each channel and are spaced along a first longitudinal axis.

In a second aspect of the invention this is accomplished by providing a second group of semi-circular flow openings on said channel, said second group of flow openings are located along a top side of the channels and are spaced along a second longitudinal axis.

The foregoing and other aspects will become apparent from the following detailed description of the invention when considered in conjunction with the accompanying drawing figures.

DESCRIPTION OF THE DRAWING FIGURES

DESCRIPTION OF THE PREFERRED EMBODIMENT

Figure 1:
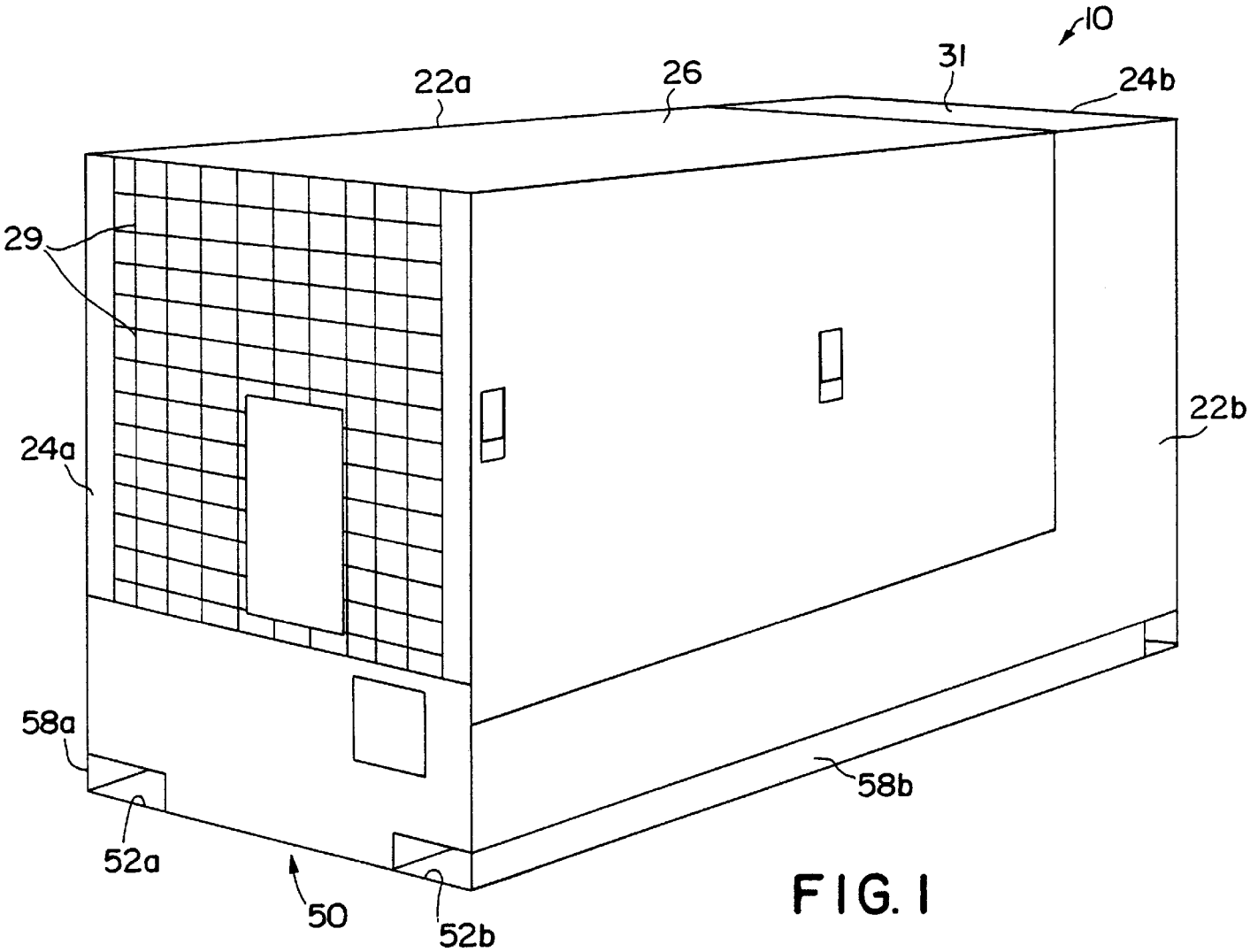
FIG. 1 is an isometric view of a compressor package that includes the base of the present invention.

Turning now to the drawings wherein like parts are referred to by the same number throughout the several views, and particularly FIG. 1, which illustrates compressor 10 that includes base 50 of the present invention. Compressor 10 is referred to by those skilled in the art as a utility compressor that is mounted on a truck bed and transported to a sight where compressed air is required. However, it should be understood that it is contemplated by the inventors that base 50 may be used in any portable or stationary fluid compressor.

In addition to base 50, compressor 10 includes housing enclosure 20 comprised of longitudinal sides 22*a,* 22*b;* lateral sides 24*a,* and 24 which join the longitudinal sides; and top 26 which joins the lateral and longitudinal sides. The housing enclosure sides are fastened or otherwise conventionally connected to base 50 and the housing enclosure 20 and base together define a compression chamber 27. Inlet openings 29 are provided on front lateral side 24*a,* and exhaust opening 31 is provided along top 26.

Figure 2:
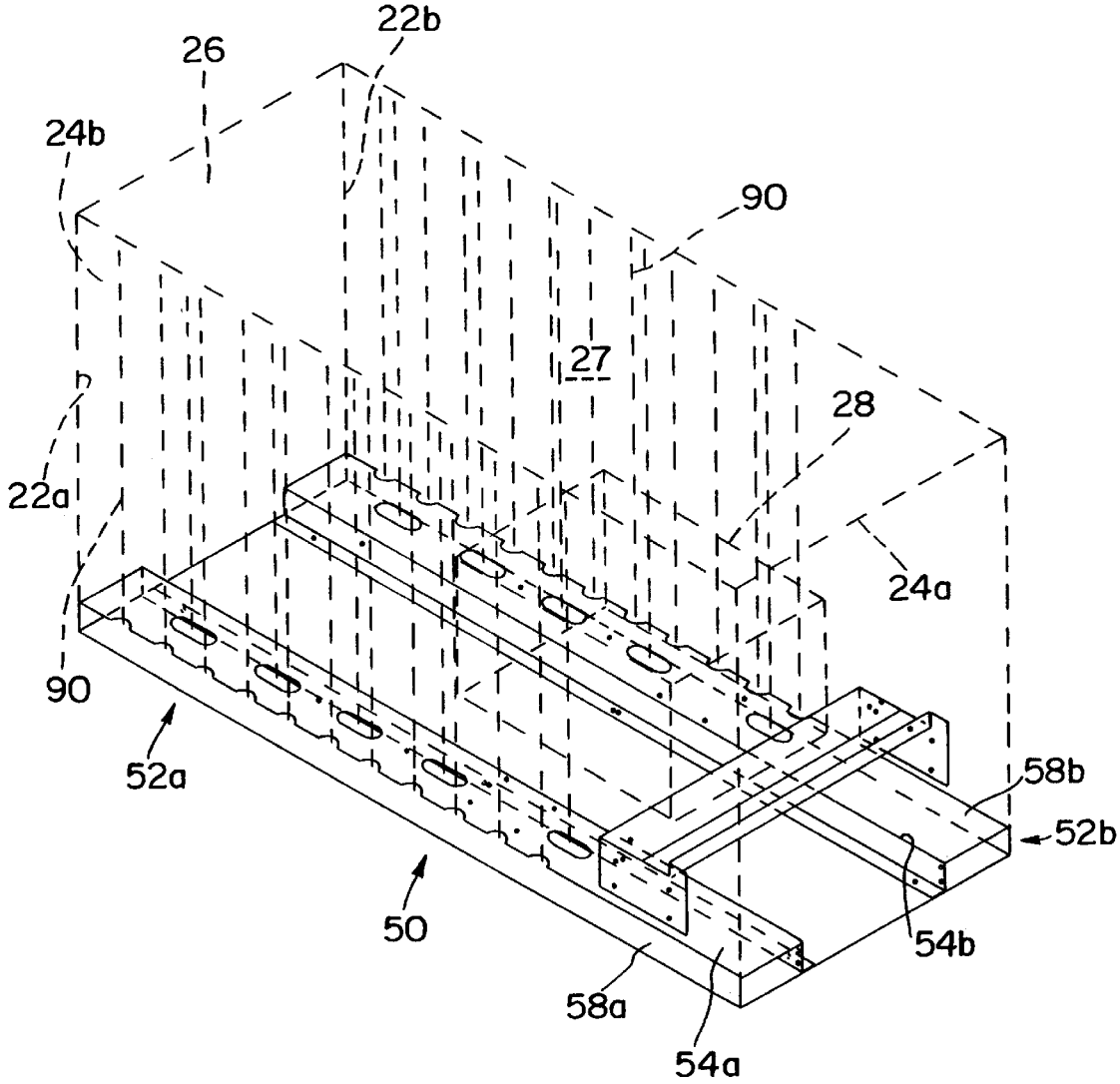
FIG. 2 is the view of FIG. 1 with the compressor housing removed.

Compressor 10 includes a conventional compression module 28 which may be an airend comprised of interengaging male and female rotors that rotate about parallel axes during operation. The compression module is driven by a prime mover 30 which may be a diesel engine. The other mechanical and electrical components of compressor 10 illustrated in FIG. 2 are well known to one skilled in the art and therefore do not need to be described in further detail.

Figure 3:
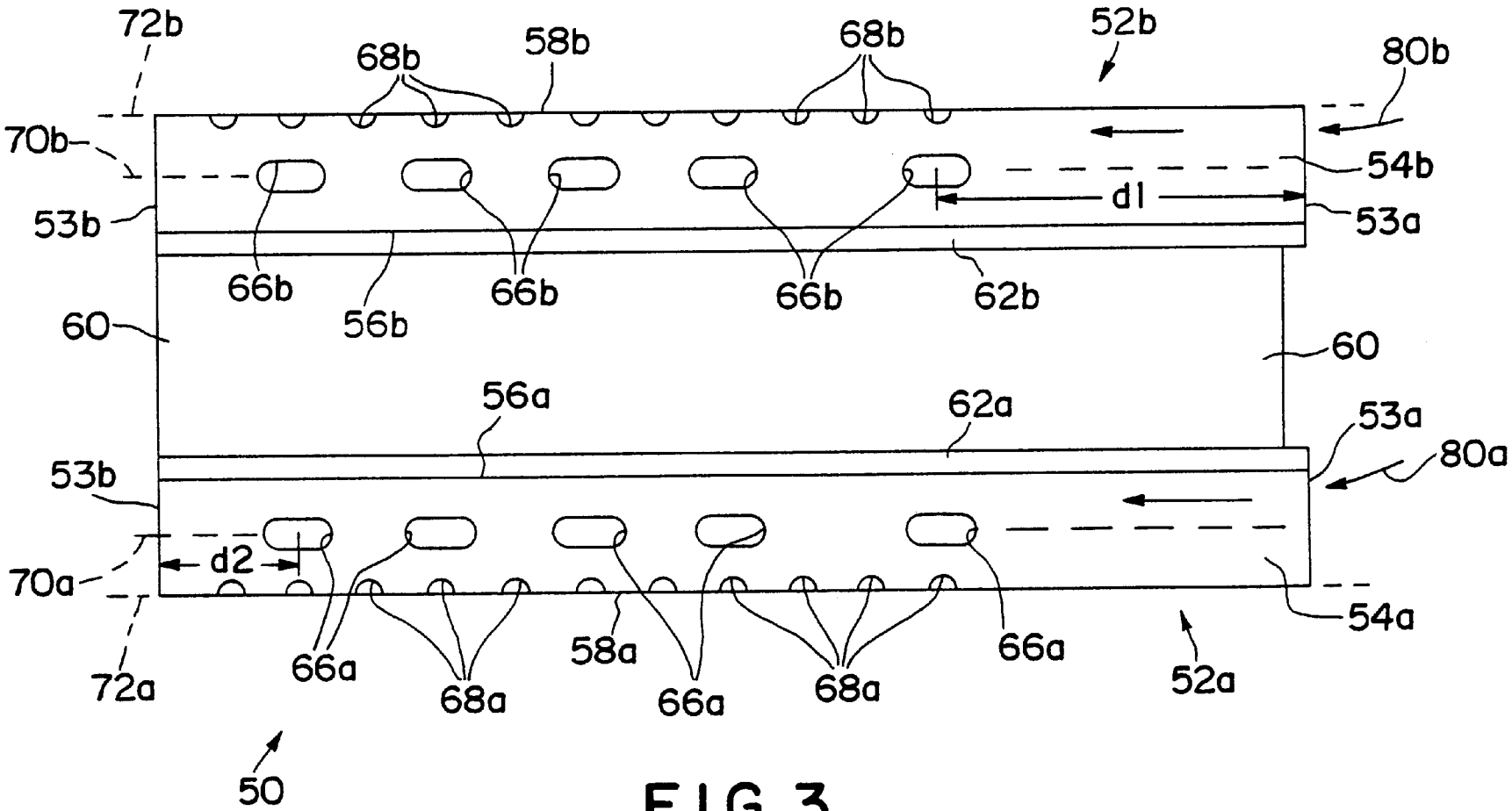
FIG. 3 is a top view of the base of the fluid compressor shown in FIGS. 1 and 2.

FIG. 3 shows the base 50 of the present invention. Base 50 includes a pair of substantially parallel, elongate hollow channels 52*a* and 52*b*. The channels are rigid and are adapted to receive the forks of a forklift or other machine for lifting or other wise moving compressor 10. The channels have open ends which permit the forklift forks to be inserted at either end and also permit the flow of ambient air through the channels during compressor operation.

The rectangular cross sections of the channels are defined by top sides 54*a,* 54*b,* interior sides 56*a,* 56*b,* exterior sides 58*a,* 58*b,* and bottom side 60. Flanges 62*a,* 62*b* are made integral with interior sides 56*a,* 56*b* respectively and each flange is bolted or otherwise fixed to bottom side 60 to maintain the fixed channel positions and cross section. The base 50 is made from a single piece of rigid metal and during manufacturing a series of conventional bending operations are performed on the metal work piece to form the rectangular-shaped channels. Although two parallel channels are shown, it should be understood that any suitable number of channels like channels 52*a,* and 52*b* may be used however, at least two channels must be provided in base 50.

The channels are separate discrete members and are not flow connected. Each channel extends longitudinally between the lateral sides of the compressor housing. As shown in FIG. 1, substantially all of the compressor components are located between the channels. By providing separate channels that are not flow connected, and locating substantially all of the compressor components between the flow channels, the desired volume of uncompressed ambient fluid can be supplied effectively to the compression module in the manner described below.

As shown in FIG. 3, the top sides 54*a,* and 54*b* include openings 66*a* and 66*b;* and 68*a,* 68*b*. The first group of fluid supply openings 66*a* and 66*b* are substantially oval and the second group of fluid supply openings 68*a* and 68*b* are substantially semicircular. The first group of openings 66*a,* 66*b* are spaced longitudinally along respective longitudinal axes 70*a,* 70*b*. The second group of openings 68*a,* 68*b* are provided on top surfaces 54*a,* 54*b* and are spaced longitudinally along an axis 72*a,* 72*b* defined by the edge joining the top and exterior sides 58*a,* 58*b* of the channels. As shown in FIG. 3, in the direction of fluid flow 80*a,* 80*b,* the distance d1, separating leading openings 66*a,b,* and 68*a,b* are from channel end 53 is greater than distance d2 separating trailing openings 66*a,b* and 68*a,b* from channel end 53*b*.

For purposes of describing the preferred embodiment of the invention five openings 66*a,* 66*b* and eleven openings 68*a,* 68*b* are shown however it should be understood that any number of openings may be provided in top sides 54*a,* 54*b*. Approximately 20%–25% of the volume of ambient air required to meet compressor 10 demands for compression, cooling and combustion air is supplied to compressor through the first and second groups of openings.

During operation of compressor 10, ambient air is drawn into channels 52*a,* and 52*b* through open ends 53*a,* in the direction of arrows 80*a* and 80*b*. The air continues downstream through the channels and substantially vertically upward through openings 66*a,* and 66*b* and 68*a* and 68*b*. The volume of air that flow vertically is supplied to the compressor inlet and is compressed by the compression module.

By providing the openings along the top of the discrete channel members, the size of the housing openings may be reduced, thereby limiting the noise emitted by compressor 10.

While we have illustrated and described a preferred embodiment of our invention, it is understood that this is capable of modification, and we therefore do not wish to be limited to the precise details set forth, but desire to avail ourselves of such changes and alterations as fall within the purview of the following claims. By the present invention, required ambient fluid is supplied to the compressor, the size of the compressor housing openings may be reduced by about 20%–25%, and the noise emitted by the compressor is minimized.

Having described the invention, what is claimed is:

1. A compressor, comprising: a base; a housing supported on said base, said housing and base defining a compression chamber; and a compression module supported on said base within said compression chamber, said base including at least two support channels, each of the at least two support channels including a first group of flow openings for supplying a volume of uncompressed fluid to the compression module.

2. The compressor as claimed in claim 1 wherein the first group of flow openings are spaced longitudinally along the channels.

3. The compressor as claimed in claim 2 wherein the compressor includes a second group of flow openings spaced longitudinally along the channels.

4. The compressor as claimed in claim 2 wherein each of the flow openings in the first group of flow openings is substantially oval.

5. The compressor as claimed in claim 3 wherein each of the flow openings in the second group of flow openings is semicircular.

6. The compressor as claimed in claim 5 wherein each channel has a respective longitudinal edge that defines an axis, each of the flow openings in the second group being located along one of the respective axes.

7. A compressor, comprising: a base; a housing supported on said base, said housing and base defining a compression chamber; and a compression module supported on said base within said compression chamber, said base including a plurality of discrete support channels, each of the support channels having a substantially rectangular cross-section defined by a top side, exterior side, interior side and base, the topside and base joining the exterior and interior sides the top side of each channel including a first group of flow openings for supplying a volume of uncompressed fluid to the compression module.

8. The compressor as claimed in claim 7 wherein the uncompressed fluid is discharged from the flow openings at a location in the compression chamber between the compressor housing and the compression module.

* * * * *